US006474569B1

(12) United States Patent
Brundish et al.

(10) Patent No.: US 6,474,569 B1
(45) Date of Patent: Nov. 5, 2002

(54) FUEL INJECTOR

(75) Inventors: Kevin D. Brundish; Christopher W. Wilson, both of Farnborough; John R. Tippetts, Sheffield, all of (GB)

(73) Assignee: Quinetiq Limited, London (GB)

( * ) Notice: Subject to any disclaimer, the term of this patent is extended or adjusted under 35 U.S.C. 154(b) by 0 days.

(21) Appl. No.: 09/555,124

(22) PCT Filed: Dec. 18, 1998

(86) PCT No.: PCT/GB98/03733

§ 371 (c)(1),
(2), (4) Date: May 25, 2000

(87) PCT Pub. No.: WO99/32828

PCT Pub. Date: Jul. 1, 1999

(30) Foreign Application Priority Data

Dec. 18, 1997 (GB) ..... 9726697

(51) Int. Cl.[7] ..... B05B 7/10; B05B 1/08

(52) U.S. Cl. ..... 239/406; 239/404; 239/405; 239/423; 239/589.1; 239/DIG. 3; 60/39.23; 60/748

(58) Field of Search ..... 239/400, 403, 239/404, 405, 406, 407, 412, 413, 416.5, 417.5, 422, 423, 424, 589.1, DIG. 3, 419.3; 60/39.23, 748; 137/803, 826, 833, 835

(56) References Cited

U.S. PATENT DOCUMENTS 3,593,518 A 7/1971 Gerrard
3,631,675 A * 1/1972 Keiter ..... 60/39.23 X
3,660,981 A * 5/1972 Stevens ..... 137/803 X
3,703,259 A * 11/1972 Sturgess et al. ..... 239/400
3,915,387 A * 10/1975 Caruel et al. ..... 239/400
3,937,011 A * 2/1976 Caruel et al. ..... 239/404 X
4,259,840 A 4/1981 Tenney
4,446,692 A * 5/1984 Adkins ..... 60/39.23
4,817,863 A 4/1989 Bragg et al.
5,417,070 A * 5/1995 Richardson ..... 60/748
5,505,045 A 4/1996 Guzowski et al.
5,737,921 A * 4/1998 Jones et al. ..... 60/748 X

FOREIGN PATENT DOCUMENTS

DE 40 14 693 A 11/1991

* cited by examiner

*Primary Examiner*—Steven J. Ganey
(74) *Attorney, Agent, or Firm*—Nixon & Vanderhye P.C.

(57) ABSTRACT

A fuel injector including a combustion air flow conduit, a fuel inlet and, swirlers to mix the air and fuel flowing therethrough, additionally comprising fluidic control diverters including at least one control port, such that flow of control air through said control port allows variation in the degree of flow resistance to which combustion air is subjected. For example, control air flowing through the control port may impart swirl to the combustion air flow from the inlet, thereby subjecting the combustion air flow to increased resistance. Alternatively a fluidic diverter may selectively divert the main flow to either the first or second sub-conduits, each sub-conduit subjecting combustion air to different degrees of flow resistance.

9 Claims, 6 Drawing Sheets

FUEL INJECTOR

BACKGROUND OF THE INVENTION

1. Field of the Invention

The invention relates to fuel injectors wherein air and fuel are mixed before combustion. It has particular application to fuel injectors used for combustors in gas turbine engines.

2. Discussion of Prior Art

Gas turbine engines include an air intake through which air is drawn and compressed by a compressor and thereafter enters a combustor at one or more ports. Fuel is injected into the combustion chamber by means of a fuel injector where it mixed with compressed air from the various inlet ports and burnt. Exhaust gases are passed out of an exhaust nozzle via a turbine which in turn drives drive the compressor. In addition to air flow into the combustion chamber through the air inlet ports, air also enters the combustion chamber via the fuel injector itself. The fuel injector is therefore different from fuel injectors in Diesel engines, for example, in that air is mixed with fuel before entering the combustion chamber. Fuel injectors therefore provide an air/fuel "spray" comprising of droplets of fuel atomised in air which enters the combustion chamber.

Conventional combustors take a variety of forms. They generally comprise a combustion chamber in which large quantities of fuel are burnt such that heat is released and the exhaust gases are expanded and accelerated to give a stream of uniformly heated gas. Generally the compressor supplies more air than is needed for complete combustion of the fuel and often the air is divided into two or more streams, one stream introduced at the front of the combustion chamber where it is mixed with fuel to initiate and support combustion along with the air in the fuel air mixture from the fuel injector, and one stream used to dilute the hot combustion product to reduce the temperature to a value compatible with the working range of the turbine.

Gas turbine engines for aircraft are required to operate over a wide range of conditions which involve differing ratios of the mass flows of the combustion and dilution air streams. To ensure a high combustion efficiency it is usual for the proportion of the total airflow supplied to the burning zone to be determined by the amount of fuel required to be burned to produce the necessary heat input to the turbine at the cruise condition. An ideal air/fuel mixture ratio at cruise usually leads to an over rich mixture in the burning zone at high power conditions (such as take-off) with resultant soot and smoke emission. It is possible to reduce smoke emission at take-off by weakening the burning zone mixture strength but this involves an increase in primary zone air flow which reduces stability and makes ignition of the engine difficult to achieve, especially at altitude.

The temperature rise of the air in the combustor will depend on the amount of fuel burnt. Since the gas temperature required at the turbine varies according to the operating condition, the combustor must be capable of maintaining sufficient burn over a range of operating conditions. Unwanted emissions rise with increase in temperature and therefore it is desirable to keep the temperature low to reduce emissions of oxides of nitrogen. With increasingly stringent emission legislation, combustion temperature is an increasingly important factor and it is necessary that the combustor operates at temperatures of less than 2100K. However at low temperatures, the efficiency of the overall cycle is reduced.

It is a requirement for commercial airliners to decelerate rapidly in the case of potential collisions. In order to decelerate a gas turbine from high power to low power, the fuel flow to the engine must be reduced. Although the reduction in fuel flow is almost instantaneous, the rate of reduction of engine airflow is relatively slow because of the inertia of rotating parts such as turbines, compressors, shafts etc. This is produces a weak mixture of fuel and this increases the risk of flame extinction, especially at altitude. It is not always easy to relight the flame especially when the combustor is set to run weakly. Because modern combustors invariably operate in lean burn principles to reduce oxide of nitrogen emissions, combustors need to be operated as close to the lean extinction limit at all engine operating conditions. If margins are set wide enough to prevent flame extinction, emissions performance is compromised.

Combustion is initiated and stabilises in the pilot zone, the most upstream section of the combustor. Low power stability requires rich areas within the primary zone of the combustor, enabling combustion to occur when the overall air/fuel ratio is much weaker than the flammability limit of kerosene.

Conventional gas turbine engines are thus designed as a compromise rather than being optimised because of the above mentioned conflicting requirements at different operating conditions. New staged design of combustors have overcome these problems to a limited extent. These comprise two combustion zones (pilot and a main zones) each having a separate fuel supply. Essentially this type of combustor is designed such that a fixed flow of about 70% enters the combustor at the main zone and the remaining 30% of the air flows to the pilot zone. In such systems the air/fuel ratio is determined by selecting the amount of fuel in each stage, allowing greater control. U.S. Pat. No. 3,593,518 describes a combustion chamber having additional air inlets whicn can be controlled to vary proportions of airflow at various points. Current gas turbine engine trends are towards increased thrust/weight ratios which require the engine to perform at higher operating compression ratios and wider ranges of combustor air/fuel ratios. Future gas turbine combustion systems will be expected to perform at higher inlet temperatures and richer air/fuel ratios at high power. Because there is little variability in the airflows supplied to each zone, the amount of optimisation achievable for each operating condition is reduced. These combustor designs will also suffer from either high nitrogen oxide and/or smoke emissions at full power, or poor stability at low power.

It is therefore a requirement to improve control of the amount of fuel, air and air/fuel ratio entering the combustion zone which reduces the problems of weak flame extinction, emissions of oxides of nitrogen and unburnt fuel, whilst maintaining good efficiency and performance at all operating conditions. US Patent describes a fuel injector for an internal combustion chamber having fluid control means to vary the resistance of flow of exhaust. It is known requirement therefore to provide a fuel injector capable of varying the airflow into the combustor pilot zone. At high power, lower airflow is required to the pilot zone and the air fuel ratio should be set to avoid fuel rich zones and emissions at high power. Improved control of the primary zone air/fuel ratio and droplet sizes will allow a maximum flame speed to be achieved which will be hard to blow out, resulting in improved stability. The airflow within the primary zone of the combustor should be controllable and be able to be varied according to the power setting. It is known to control the degree of restriction experienced by air flow through the injector such that for a set upstream pressure the amount of air (and fuel) flow through the fuel injector can be varied. In addition this would also have an effect on the flow proportions of air which flows through the other combustor inlet ports. Varying the airflow into the primary zone through the fuel injector, will also effect atomisation quality. At idle, with airblast atomiser fuel injectors, low airflow results in low air velocity through the injector. The fuel atomisation process relies on the fast moving air flowing across the sheet of liquid fuel at higher power condition; higher airflow velocity through the fuel injector would promote good atomisation, fine droplets and low emissions. Thus modulating the airflow through the fuel injector (the largest contribution to airflow into the primary zone in modern combustion systems), would improve stability and reduce high power emissions.

One known method of providing greater control of air flow and air/fuel ratio is to use fuel injectors having variable geometry which control the amount of air and fuel flow through the fuel injector. Variable geometry fuel injectors have moving parts whose position alters the fuel and air flow resistance. Such designs have not found favour as they are not robust. In the high temperature atmosphere of the combustor and due to the complex nature of fuel injectors, moving parts are unreliable. It is therefore impractical to use such devices in a working gas turbine engine.

SUMMARY OF THE INVENTION

It is an object of the invention to provide flow mixing control at the fuel injector stage which can vary the air flow (or fuel) in a reliable and controllable manner.

It is an object of the invention to provide flow mixing control at the fuel injector stage which can vary the air flow (or fuel) in a reliable and controllable manner.

According to the invention is provided a fuel injector including a combustion air flow conduit, a fuel inlet, means to mix the air and fuel flowing therethrough, and fluidic control means including at least one control port, such that variation of flow of control air through said control port allows variation in the degree of flow resistance to which combustion air is subjected.

The advantage of such:a design of fuel injector is that it does not require moving parts and as such is inherently robust.

Preferably a fluid diverter is incorporated which diverts combustion air to either a first flow channel or a second flow channel each subjecting the flow to a varying degree of resistance. In a fluid diverter, the combustion air flow conduit divides into a first and second sub-conduit, said fluid control means comprising at least one port located adjacent to the confluence thus formed, such that selective over-pressure or under-pressure to the control port sets up a control flow therethrough, thereby selectively diverting the main flow to either the first or second sub-conduits, each sub-conduit subjecting combustion air to different degrees of flow resistance.

A typical modern fuel injector includes a number of swirlers. The swirling flow from the injector is required to form aerodynamic recirculation. Varying the swirl will vary the strength of the recirculation zones within the combustor, thus varying flow resistance. Preferably the fluidic control means allows variation in the degree of swirl to be varied.

BRIEF DESCRIPTION OF THE DRAWINGS

By way of example, a number of embodiments of the invention will now be described with reference to the following drawings of which

DETAILED DISCUSSION OF PREFERRED EMBODIMENTS

Figure 1:
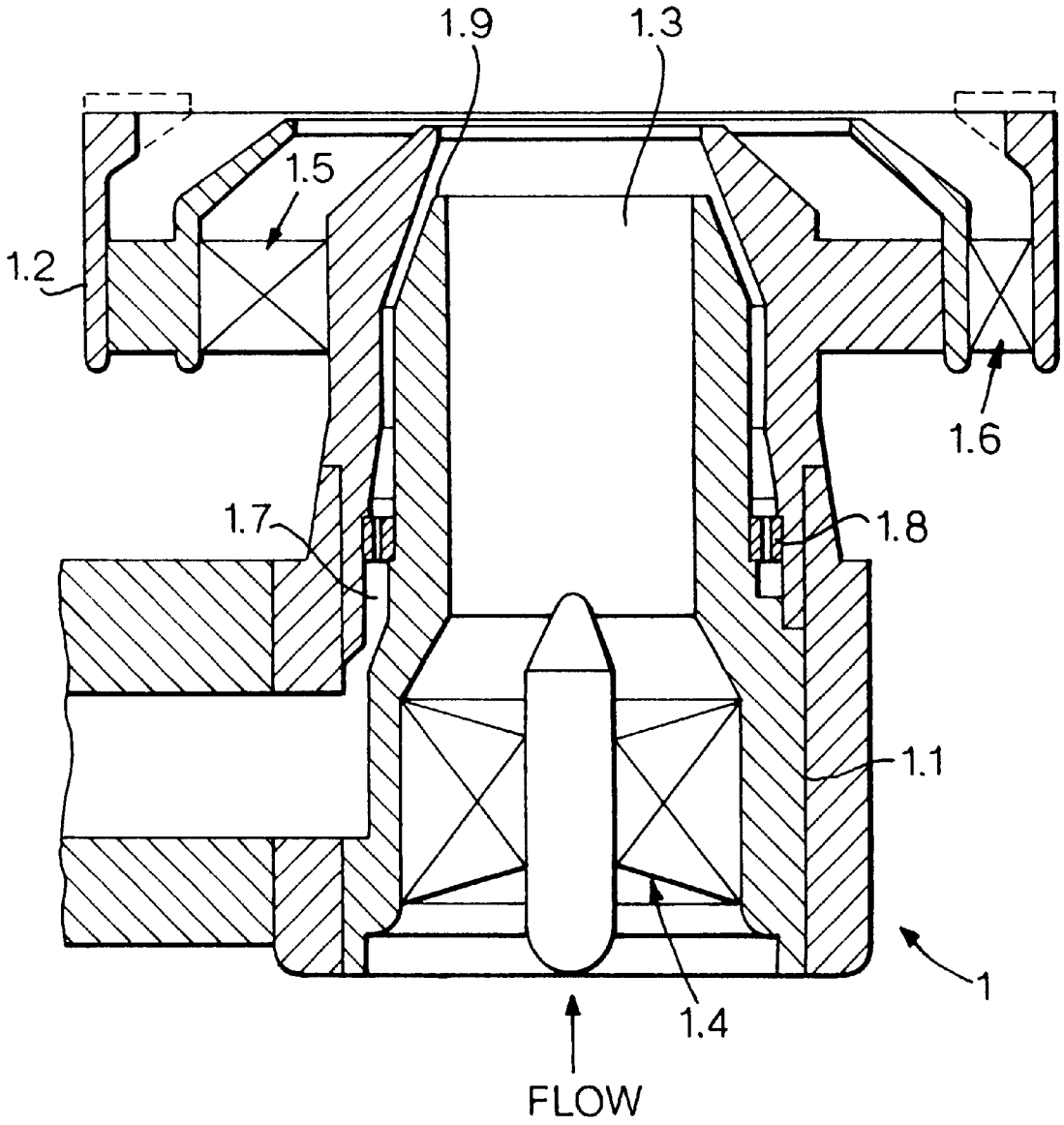
PRIOR ART Fig.1.
FIG. 1 shows a cross sectional view of a conventional atomiser fuel injector.

FIG. 1 shows a cross sectional view of a conventional fuel injector 1 for a gas turbine, comprising a main housing 1.1 and a collar 1.2 located at the end which is fitted to the combustor primary zone. Within the body is located an inner flow conduit 1.3 through which a fixed proportion of compressed air flows in the direction of the arrow and located within this is an inner air swirler 1.4. The remainder of the compressed air flows around the main body and through two annular concentric conduits each comprising a swirler which form the collar, these being referred to as "outer" and "dome" swirlers, 1.5 and 1.6 respectively. In parallel, fuel is fed into the fuel injector, through a fuel channel 1.7 and then through a fuel swirler 1.8 where it is vigorously agitated. The fuel then passes over a prefilmer 1.9 positioned concentrically about the inner air swirler 1.4 from where it is expelled from the fuel injector and mixes with turbulent air expelled from the air swirlers prior to ignition.

Figure 2:
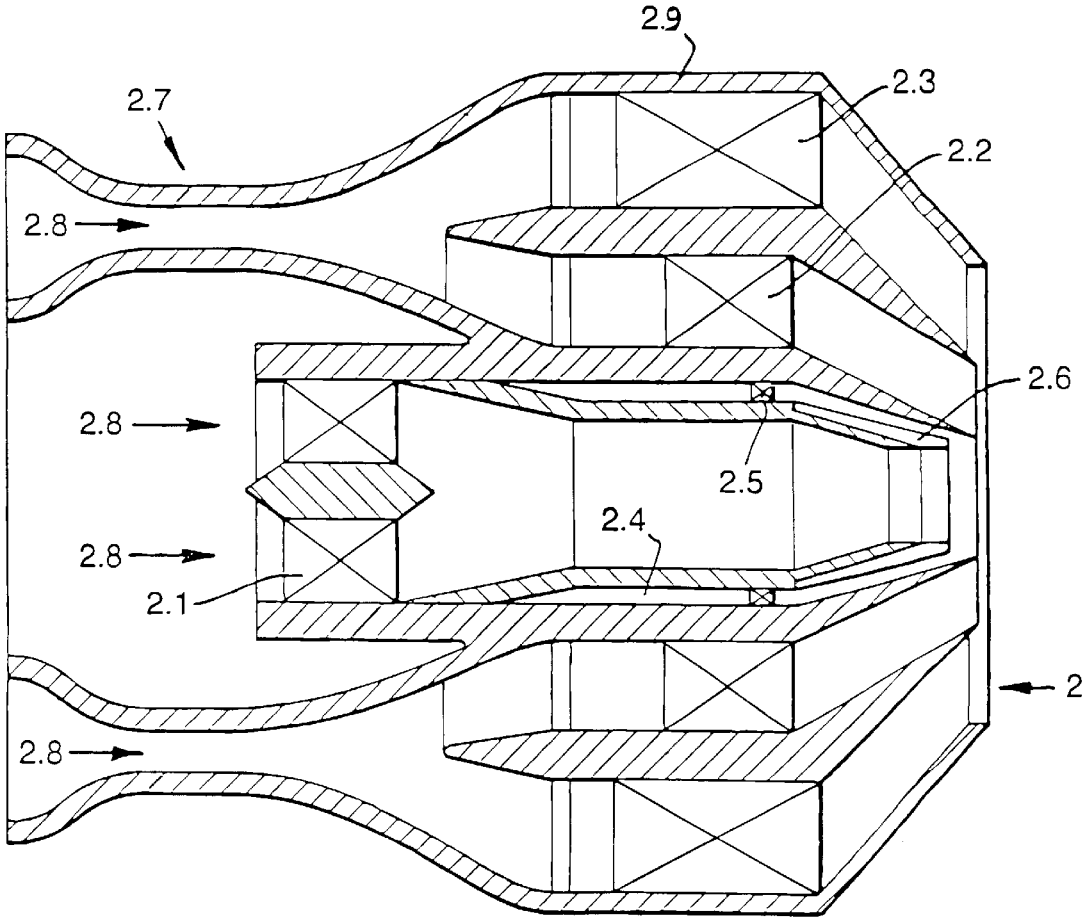
FIG. 2 shows, schematically, a cross sectional view of a fuel injector according to the present invention.

FIG. 2 shows, schematically, a cross sectional view of a fuel injector 2 according to the present invention. As with the conventional atomiser fuel injector of FIG. 1, the fuel injector of FIG. 2 comprises inner 2.1, outer 2.2 and dome 2.3 swirlers, a fuel channel 2.4, a fuel swirler 2.5 and a prefilmer 2.6. In addition, the injector comprises a fluidic diverter 2.7 which is adapted to divert an airflow into substantially one or other of the outer 2.2 or dome 2.3 swirlers. Such selection enables the degree of swirl experienced by the airflow 2.8 expelled by the fuel injector to be varied. For example, the dome swirler may subject the airflow to a greater degree of swirl than the outer swirler. Alternatively, the dome swirler 2.3 may be omitted from the outer collar 2.8 whereby airflow may be selectively passed through the collar without being subjected to swirl, thereby influencing the combustion pattern within the combustor.

Figure 3:
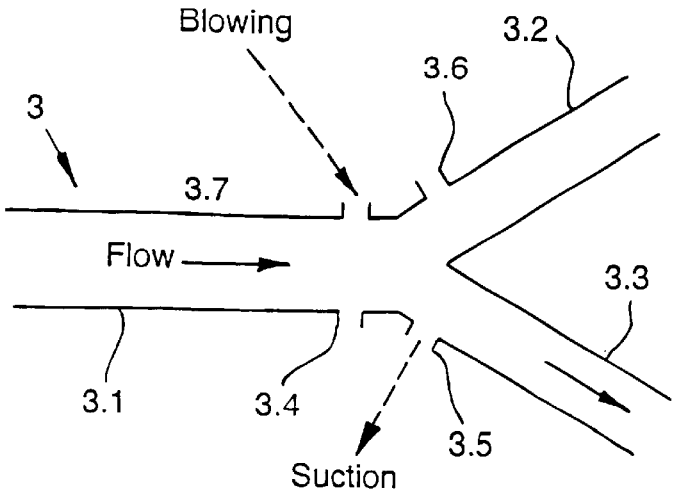
FIG. 3 shows, schematically, the fluidic diverter of the fuel injector of FIG. 2 in greater detail.

FIG. 3 shows, schematically, the fluidic diverter 3 of the fuel injector of FIG. 2 in greater detail. The diverter comprises a forked conduit wherein a main conduit 3.1 is divided into two sub-conduits 3.2 and 3.3. Control ports are located at any of one or more locations 3.4, 3.5, 3.6 or 3.7. A high speed flow, typically accelerated through a venturi (not shown), will tend to one or other of the sub-conduits dependent on a small flow of control air through one or other, or a combination of the control ports. For example, by the application of overpressure (blowing) through control port 3.7, main air flow will tend towards sub-conduit 3.3. The same effect is obtained by applying an underpressure (suction) at port 3.4. The diversion of flow to mainly one or the other of the sub conduits by small overpressure or under pressure to the control ports is due to boundary layer inertial and coanda effects. In other embodiments according to the invention, such a fluidic diverter can be used in a number of different ways to control flow and mixing both of fuel and air in combustor fuel injectors. The fluid control diverter may act as a fluidic switch to divert air to one or another direction such that the amount of swirl imparted to the flow can be selected. For example the flow could be diverted either to an exit via a swirler or directly to the exit.

It will be appreciated by a person skilled in the art that any valve arrangement whereby a flow in a main conduit can be selectively diverted into one of a plurality of subconduits could be used as an alternative to the fluidic diverter of FIG. 3, although perhaps without the advantage of the absence of moving parts.

Figure 4:
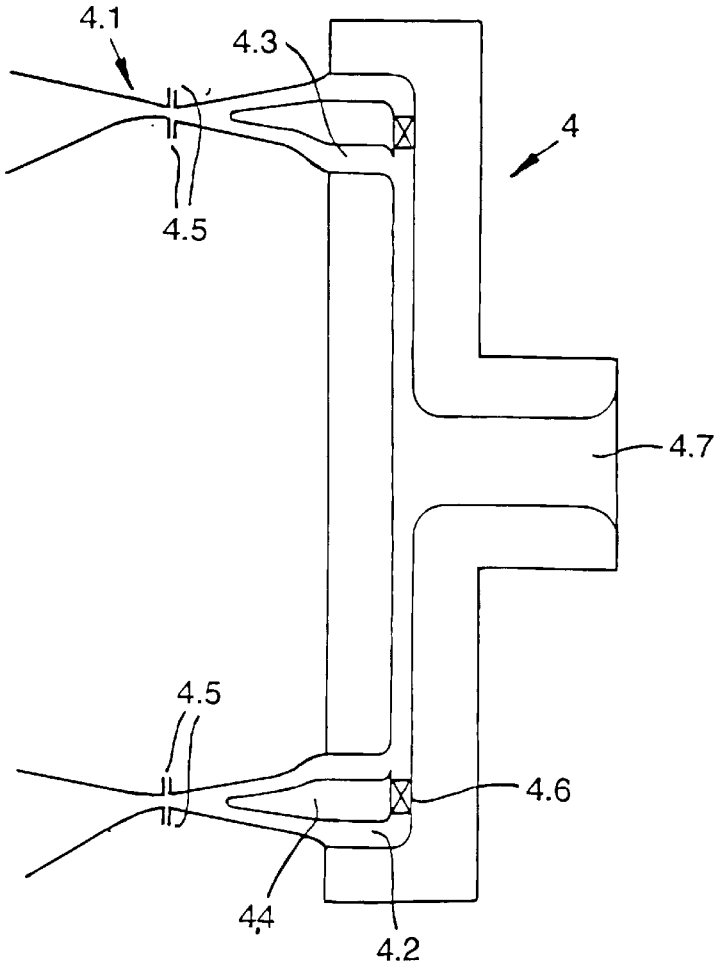
FIG. 4 shows, schematically, a cross sectional side elevation of a second fuel injector according to the invention.

FIG. 4 shows, schematically, a cross sectional side elevation of a second fuel injector 4 according to the invention. The fuel injector comprises an annular fluidic diverter 4.1 and air flows: into an annular main flow conduit which is convergent-divergent form. The annular conduit divides into an outer 4.2 and inner 4.3 annular conduits by an annular tongue 4.4. Control ports 4.5 are located radially at intervals on the walls of the annular main flow conduit at the neck of the convergent/divergent section. The outer annular conduit includes an annular swirler 4.6. The inner annular conduit does not include any swirler. Both annular conduits rejoin and exit through the exit port 4.7 and into the combustor. In operation, depending on the over- or under-pressure to the control ports, the main air flow air can be diverted selectively to either the outer annular conduit thus imparting swirl to the flow, or to the inner annular conduit where no swirl is introduced. Diversion to the outer annular conduit thus causes a reduced flow to the exit port due to the increased resistance. The schematic of FIG. 4 is intended to demonstrate how the degree of swirl can be varied. For clarity, details of fuel conduits have been omitted for clarity; suitable locations of fuel conduits and other swirlers would be apparent to the person skilled in the art.

Figure 5A:
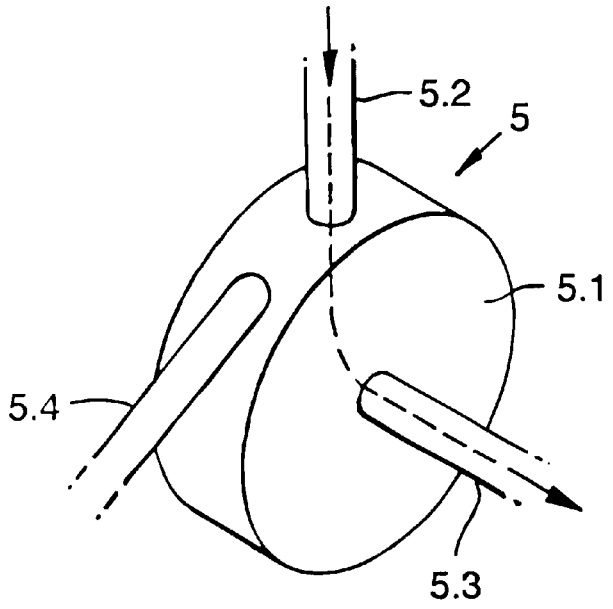
FIGS. 5*a* and 5*b* show a schematic view of a further, simple embodiment of the invention showing a vortex valve device.
Figure 5B:
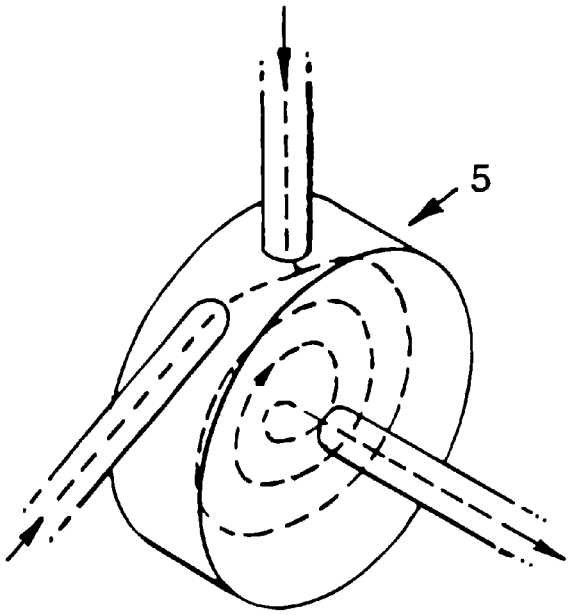

FIGS. 5*a* and 5*b* show a simplified embodiment of a fuel injector 5 which incorporates a "vortex valve" based on the same concept of using fluidic control, but using an alternative principle. It includes a cylindrical chamber 5.1 fluidically connected to a primary flow inlet conduit 5.2. A concentric exit flow port is connected to an exit conduit 5.3 which lies along the same longitudinal axis as the chamber axis. Tangentially and circumferentially orientated to the chamber is a control inlet conduit 5.4. In operation (as shown in FIG. 5*b*), introduction of a small air stream through the control conduit will have the effect of mixing with air flow from the main inlet port to produce a vortex. Swirling air will not flow through a port with the same ease as non swirled air. Thus inducing swirl results in higher drag to the main flow in and out of the chamber, and reduces air flow through the chamber. Without air flow through the control port, air simply flows from the main inlet port through the exit port in a generally direct and less restrictive route.

Such a device may include one or more control ports each connected to supply conduits entering the chambers in a generally tangential directions so as to induce swirling. It would be clear to the person skilled in the art that various other orientations (not necessarily tangential) may be possible to induce vortices and swirling thus increasing the resistance to flow. These devices may be incorporated into fuel injectors to control overall air flow through them and into the combustor. Preferably at least one swirler would be used at the exit of the fuel injector to ensure some swirl was always present.

Figure 6A:
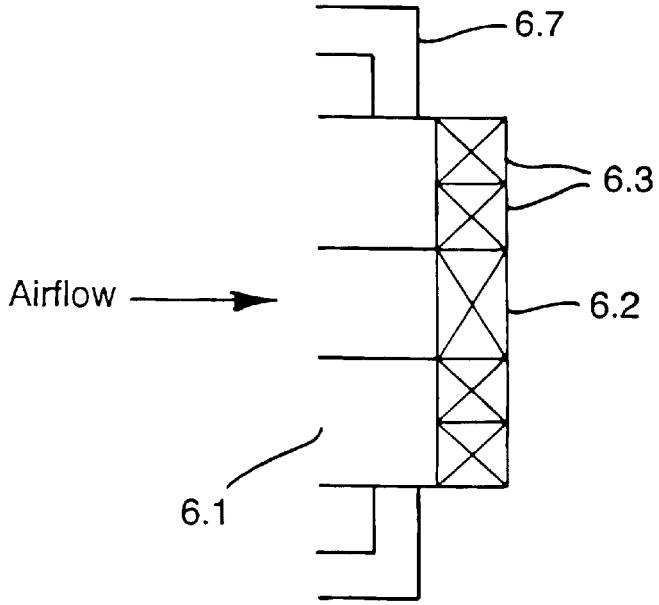
FIGS. 6*a* and 6*b* show, schematically, a cross sectional side and front elevations respectively of an embodiment of the invention incorporating a fluidic diverter radial vortex device.
Figure 6B:
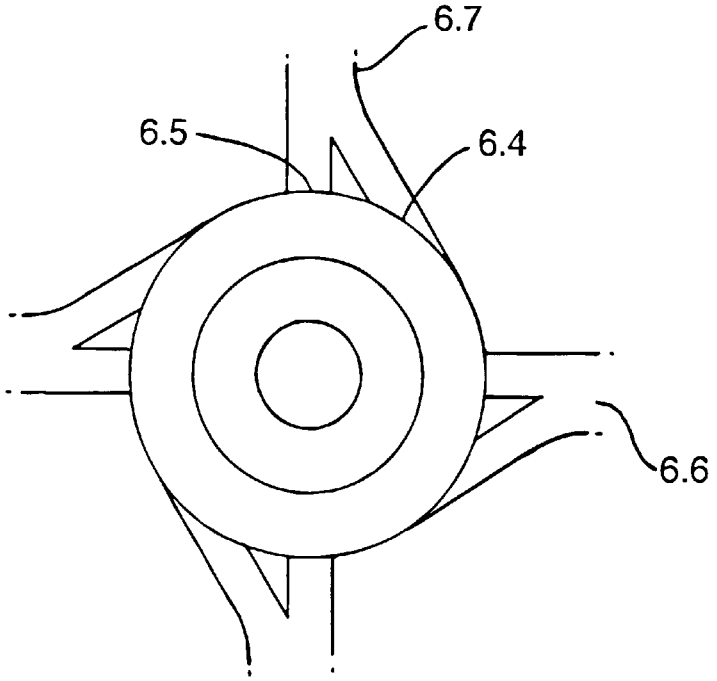

FIGS. 6*a* and 6*b* show a cross sectional side of an embodiment of the invention and a sectional elevation in the direction of airflow respectively. The fuel injector comprises a cylindrical chamber 6.1 and at the downstream end are a central swirler 6.2 and two nested outer annular swirlers 6.3. Upstream of these and circumferentially are located four pairs of inlet ports. One (6.4) port of each pair of ports are connected to a conduit which enters the chamber tangentially and the other (6.5) enter normally to the longitudinal axis of the chamber. Each pair of the tangential and normally oriented conduits form a confluence 6.6 with a common intermediate conduit 6.7. Each of the confluences effectively form a fluidic diverter as described above. Control ports (not shown) located adjacent to the confluence enable flow to be controlled so as to predominantly enter the chamber via the tangentially or normally orientated conduits as selected. Entry of air though the tangential ports will induce flow swirl, thereby increasing the resistance to flow and decreasing the flow rate through the injector. Entry of air through the normally orientated ports will not result in swirled flow through the chamber and reduces the main air flow restriction. The flow in both cases flows though the central and outer annular swirlers.

The swirl set up in the chamber may either be co-rotating or counter-rotating with respect to that set up by the fixed swirlers. This would either not effect the swirl or enhance/degrade (depending if counter/co-rotating) the swirl, resulting in a change in the resistance of combustion air flow through the chamber.

Figure 7A:
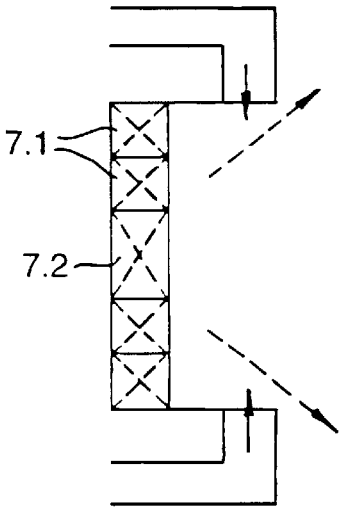
FIGS. 7*a* and 7*b* show a cross sectional elevation and sectional elevation of a yet further embodiment of the invention.
Figure 7B:
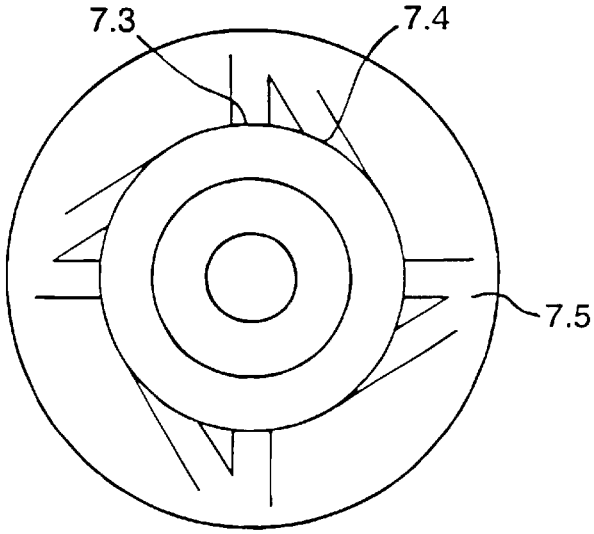

FIGS. 7*a* and 7*b* show a cross sectional side and sectional elevation in the direction of airflow respectively, of an alternative embodiment of the invention. This embodiment is similar to the one described with reference to FIG. 5 except that the annular and central swirlers (7.1, 7.2 respectively) are located upstream of the circumferentially located pairs of ports, one (7.3) of each port connected to a normally (to the chamber) orientated conduit, the other (7.4) to a tangentially orientated conduit both joined at a confluence so as to provide a fluidic diverter 7.5, having control ports (not shown). By selective air flow through the control ports at the fluid diverter, control flow is either diverted to the normally or to the tangentially arranged conduits, thus either imparting swirl or not. This would either aid or destroy the swirl created by the swirlers 7.1, 7.2 allowing swirl control. By selecting air flow direction, swirl already set up by the annular swirlers can be enhanced or reduced This allows the recirculation zones to be changed dependent on the power setting, thus aiding stability at low power.

Figure 8A:
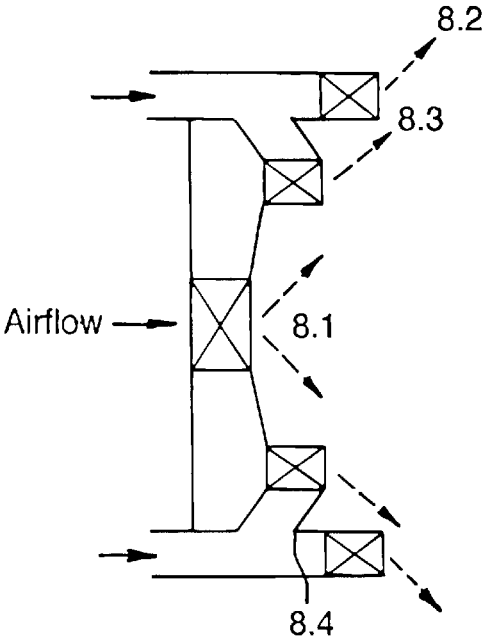
FIGS. 8*a* and 8*b* show schematic cross sectional side and front elevations respectively of a further embodiment of the invention incorporating multiple swirl chambers and fluidic diverters.
Figure 8B:
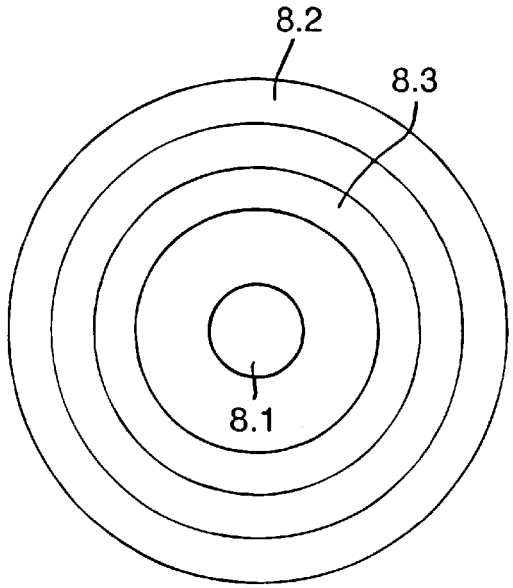

FIGS. 8*a* and 8*b* show a cross sectional elevation and sectional elevation in the direction of airflow respectively, of an embodiment of the invention wherein an annular fluidic diverter is used to supply airflow to different annular swirled chambers. An inner swirler 8.1 is provided as in a conventional fuel injector. Swirlers comprising a dome 8.2 and outer swirler 8.3 are also provided having different swirl angles, the dome swirler being of higher swirl number than the outer swirler, imparting greater swirl. Between the annular dome swirler and the outer annular swirler is located a sharp edged collar 8.4 which forms an annular confluence between an annular conduit to the dome swirler and the annular conduit to the outer swirler. A series of control ports (not shown) located radially on the sharp edged conduit and adjacent to the annular conduits is provided in a similar fashion to the fluidic diverter of FIG. 3.

In operation appropriate over and underpressure at the control ports as described above causes flow through the outer main annular conduit to either the outer annular swirler or the annular dome swirler. At low power settings the air would be routed through the high swirl number dome swirler and the fuel routed through a prefilming plate between the inner and dome swirlers. At high power the air would be routed through the lower swirl number outer swirler, and the fuel through the prefilmer between the inner and outer swirler. At low power, the air from the inner swirler would have less velocity when it reaches the prefilming plate between the inner and dome swirlers than when it reached the prefilming plate between the inner and outer. The fuel atomisation would be worse at low power, giving rise to improved stability. The higher angled swirling air would also lead to an increase in the recirculation, again aiding stability At high power, the airstream would flow through the inner and outer swirlers. The airstream would be faster allowing better atomisation.

So far the invention has been described in terms of controlling the flow rate of air through the fuel injector by altering the degree of swirl by means of fluidic control. However similar means can be used to control the flow of fuel, and by controlling the degree of fuel and air swirl the degree of air and fuel mixing can be controlled.

In the embodiments described in FIGS. 4, 5*a*, 5*b*, 6*a*, 6*b*, 7*a*, 7*b*, 8*a* and 8*b*, details of fuel conduits have been omitted for clarity. Suitable locations of fuel conduits and swirlers would be apparent to the person skilled in the art, not being limited to the configuration of the fuel injector shown in FIG. 2.

What is claimed is:

1. A fuel injector for delivering a fuel/air mixture into a combustion chamber, said injector comprising:

a combustion air flow conduit, a fuel inlet, means to mix the air and fuel flowing therethrough, means for imparting swirl to air flowing therethrough, fluidic control means including at least one control port, such that variation of flow of control air through said at least one control port causes variation in the degree of swirl and flow resistance to which combustion air is subjected during passage of combustion air through said injector.

2. A fuel injector comprising:

a combustion air flow conduit, a fuel inlet, means to mix the air and fuel flowing therethrough, and fluidic control means including at least one control port, such that variation of flow of control air through said at least one control port allows variation in the degree of flow resistance to which combustion air is subjected, including a chamber substantially circular in cross section and having combustion air inlet and at least one exit port, said at least one control port being connected to a control conduit connected to the chamber in a substantially tangential direction, such that control air flowing through the control port imparts swirl to the combustion air flow from the combustion air flow conduit.

3. A fuel injector comprising:

a combustion air flow conduit, a fuel inlet, means to mix the air and fuel flowing therethrough, and fluidic control means including at least one control port, such that variation of flow of control air through said at least one control port allows variation in the degree of flow resistance to which combustion air is subjected, wherein said combustion air flow conduit divides into a first and second sub-conduit which form a fist confluence, said at least one control port located adjacent to the first confluence, such that selective over-pressure or under-pressure to the at least one control port sets up a control flow therethrough, thereby selectively diverting the main flow to either the first or second sub-conduits, each sub-conduit subjecting combustion air to different degrees of flow resistance.

4. A fuel injector as claimed in claim 3 wherein said sub-conduits are substantially orientated in the same axis as the combustion air flow conduit.

5. A fuel injector as claimed in claim 3 wherein at least one of said subconduits includes swirlers or restrictors.

6. A fuel injector as claimed in claim 3 wherein said combustion air conduit and said first and second sub conduits are annular.

7. A fuel injector as claimed in claim 3 additionally including a chamber of substantially circular cross-section to which said sub-conduits are connected, said first sub-conduit joining said chamber at a less tangential orientation than said second sub-conduit, such that selective flow through the second sub-conduit causes a greater degree of swirl of air flow in said chamber than that arising from selective flow through said first sub-conduit, thereby selectively subjecting combustion air to differing degrees of flow resistance.

8. A fuel injector as claimed in claim 7, said combustion air flow conduit further dividing upstream of said first confluence to form a second confluence, said second confluence comprising:

a first divided conduit which connects to said first confluence, a second divided conduit leading to said chamber, such that said selective diversion of flow to said first or second sub-conduit at said first confluence allows selection of the degree of swirl imparted to combustion air flow into the chamber from said second divided conduit.

9. A fuel injector as claimed in claim 8 wherein said second divided conduit includes a swirler.

* * * * *

UNITED STATES PATENT AND TRADEMARK OFFICE

CERTIFICATE OF CORRECTION

PATENT NO. : 6,474,569 B1
DATED : November 5, 2002
INVENTOR(S) : Brundish et al.

It is certified that error appears in the above-identified patent and that said Letters Patent is hereby corrected as shown below:

Title page,
Item [73], Assignee, "Quinetiq Limited" should read -- QinetiQ Limited --.

Signed and Sealed this

Fourth Day of March, 2003

JAMES E. ROGAN
*Director of the United States Patent and Trademark Office*